United States Patent [19]

Arima

[11] 4,223,305

[45] Sep. 16, 1980

[54] SINGLE STATION TYPE IONIZATION SMOKE SENSOR

[75] Inventor: Takeo Arima, Tokyo, Japan

[73] Assignee: Hochiki Corporation, Tokyo, Japan

[21] Appl. No.: 934,591

[22] Filed: Aug. 17, 1978

[30] Foreign Application Priority Data

Aug. 19, 1977 [JP] Japan ..... 52/111312

[51] Int. Cl.[2] ..... G08B 17/10

[52] U.S. Cl. ..... 340/629; 252/381; 353/61

[58] Field of Search ..... 340/628, 629; 250/381, 250/382, 384, 385; 363/60, 61

[56] References Cited

U.S. PATENT DOCUMENTS 4,004,288 1/1977 Webb, Jr. ..... 340/628

*Primary Examiner*—John W. Caldwell, Sr.
*Assistant Examiner*—Daniel Myer
*Attorney, Agent, or Firm*—Wenderoth, Lind & Ponack

[57] ABSTRACT

The present invention is a single station type ionization smoke sensor which operates on a dc battery having a voltage lower than the voltage of about 9 volts usually needed for operation of ionization-type smoke sensors. The smoke sensor of the present invention includes a voltage booster means for boosting the battery voltage, a voltage detector means which detects when the boosted voltage falls below a predetermined value and an alarm energization means which energizes an alarm when an ionization type smoke detector means detects combustion products or when the voltage detector means detects a drop in the boosted voltage below the predetermined voltage.

3 Claims, 4 Drawing Figures

SINGLE STATION TYPE IONIZATION SMOKE SENSOR

BACKGROUND OF THE INVENTION

The present invention relates to a single station type ionization smoke sensor consisting of an ionization-type smoke sensor, a fire alarming device and a battery-replacement alarming device, which are accommodated in a single housing and which work with one or two normal dry batteries, and particularly to a single station type ionization smoke sensor which is capable of performing these three functions using a power-supply battery which produces a voltage smaller than the voltage required for widely available ionization-type smoke sensors.

A conventional battery-powered smoke sensor has been disclosed, for example, in U.S. Pat. No. 4,030,086, having three functions such as detection of combustion, generation of a fire alarm, and generation of an alarm for indicating that the battery is depleted. The smoke sensor disclosed in this U.S. patent is powered by a Mallory Battery, Model No. 304116 having an initial voltage of 12.3 volts, which voltage decreases to 10.6 volts when 60% of its power is consumed. The ionization-type sensors for detecting combustion are usually supplied with a voltage higher than 9 volts. In order to drive such a conventional ionization-type smoke sensor using normal dry batteries having an initial voltage of 1.5 volts, it is necessary to use six or more such batteries occupying a space which can not be accommodated in a housing of the usually employed size.

SUMMARY OF THE INVENTION

The object of the present invention is to provide a single station type ionization smoke sensor which is powered by a few dry batteries which supply a voltage smaller than the 9 volts which is required for energizing an ionization-type smoke sensor, and which also indicates drop of the required operation voltage, said single station type ionization smoke sensor having one electrode of the ionization-type smoke sensor connected to a terminal of a d-c power supply through a power feed conductor and the other electrode of the ionization-type smoke sensor connected through a booster conductor to one terminal of a branch resistor element which has its other terminal connected to the power feed conductor, a booster means having an input terminal connected to said booster conductor to boost the booster conductors between two resistors of said ionization-type smoke sensor and branch resistor element, a voltage detector means connected between the input terminal of said booster means and said branch resistor element, a signal transmission circuit which connects an intermediate electrode of said ionization-type smoke sensor to a fire alarm means, and means for applying the output of the voltage detector means to the signal transmission circuit.

Referring to the power feed conductor connected between one terminal of the d-c power supply and one electrode of the ionization-type smoke sensor, the very high impedance possessed by the ionization-type smoke sensor makes it possible to boost the voltage of a secondary conductor which branches from the power feed conductor and which is connected to the other electrode of the ionization-type smoke sensor. That is, if a resistor element is inserted in a branched portion between the secondary conductor and the power feed conductor, the resistance between the two terminals of the secondary conductor enables the voltage of the secondary conductor itself to be boosted substantially independent of the power feeding conductor. Particularly, in order to connect the power feed conductor and the secondary conductor in a branched manner, connection of a resistor and a Zener diode in series between them is recommended. If the connection point between the resistor and the Zener diode is connected to the input terminal of the voltage detector means, the voltage detector means detects the boosted voltage instead of the battery voltage. A voltage multiplying rectifier circuit REC is desirably used as a booster means.

According to the present invention, a household ionization-type smoke sensor employing an ionization-type smoke sensor can be operated using one or two ordinarily used dry batteries. Commonly available ionization-type smoke sensors require a power supply voltage of 9 volts to 12 volts to detect the smoke produced by a fire. To supply such a high voltage, therefore, particular batteries, such as the mercury batteries used so far, are required. Therefore, these particular batteries must be obtained when the batteries are to be renewed. Furthermore, the battery operation of ionization-type sensors of this kind should be tested once a week, and the life expectancy of the battery is desirably as long as at least one year.

In view of the abovementioned facts, the present invention is to provide an ionization-type smoke sensor which operates using commercially available 1.5-volt dry batteries as a power supply, which functions to indicate of the depletion of the power supply, and which can be safely used at home, having a good appearance.

DESCRIPTION OF THE PREFERRED EMBODIMENTS

Figure 1:
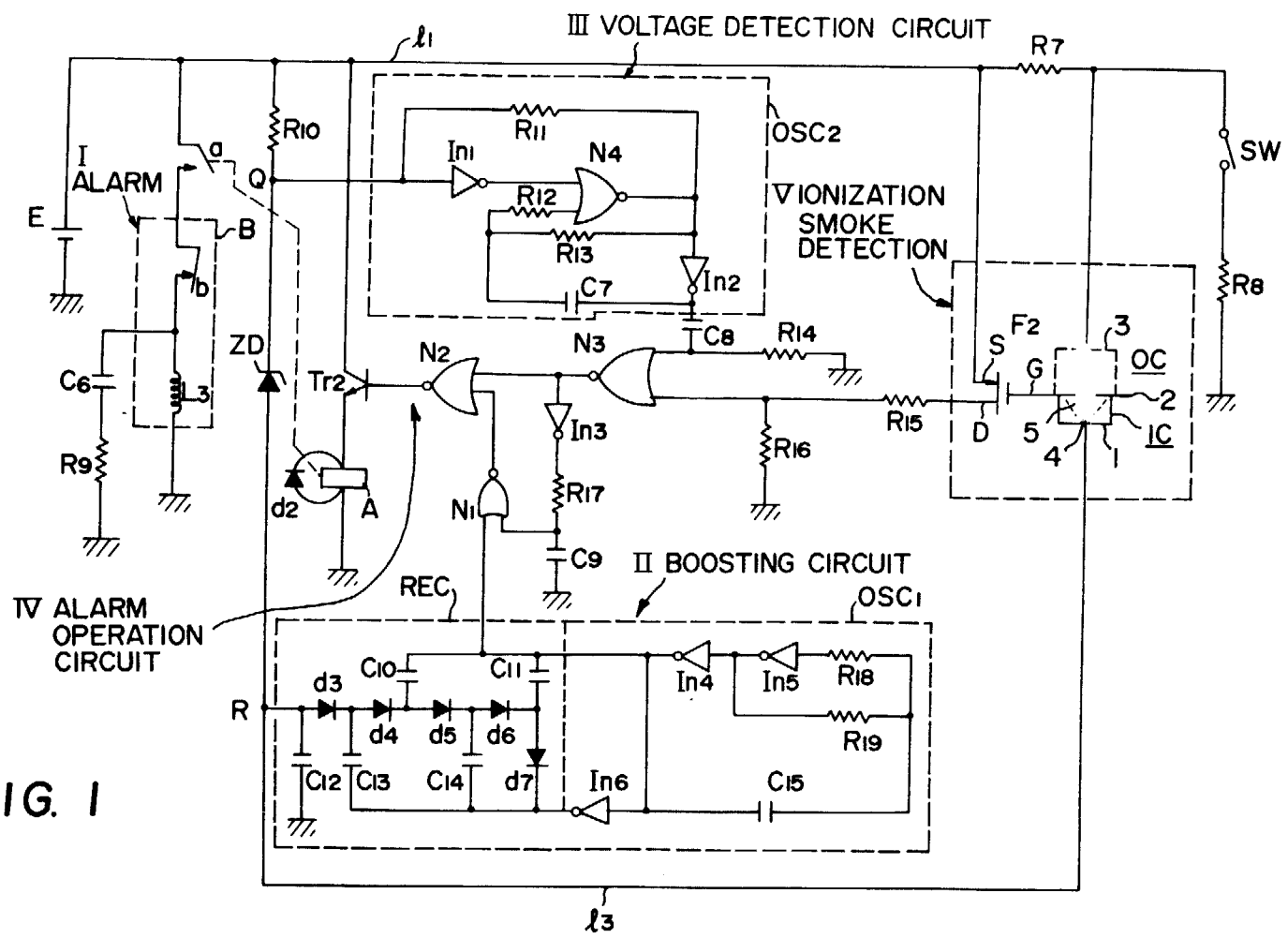
FIG. 1 is a circuit diagram of an ionization-type smoke sensor according to the present invention.

FIG. 1 shows a first embodiment of the ionization-type smoke sensor according to the present invention. The symbol E represents a power supply consisting of one or two 1.5-volt dry batteries, and $l_1$ a conductor connected to the positive electrode of the power supply E. The negative electrode is grounded. An alarming device I, a booster circuit II, a battery capacity monitoring circuit III, an alarm energizer circuit IV, and a smoke detector V are connected between the conductor $l_1$ and the ground. Referring to the alarming device I, a relay contact a, and a buzzer consisting of a buzzer breaker contact point b and a coil $L_3$ surrounded by a dotted line B, are connected between conductor $l_1$ and the ground, and a capacitor $C_6$ and a resistor $R_9$ are connected in series from the connection point of the contact b and coil $L_3$ to ground. With reference to the smoke detector V, an outer electrode 3 of an outer ionization chamber OC is connected to the conductor $l_1$ via a resistor $R_7$, and a test switch SW and a resistor $R_8$ are connected in series between the electrode 3 and ground. Further, an inner electrode 1 of an inner ionization chamber IC is connected to an output terminal R of the booster circuit via a conductor $l_3$, and this terminal R is connected to the conductor $l_1$ via a Zener diode ZD having the polarity shown and a resistor $R_{10}$. An intermediate electrode 2 is connected to the gate of a field effect transistor $F_2$ which performs a switching function. The source of field effect transistor $F_2$ is connected to the conductor $l_1$, and the drain thereof is connected to a first input terminal of a NOR circuit $N_3$ of the alarm energizer circuit IV via a resistor $R_{15}$. As is well known, the inner ionization chamber IC may be replaced by a high resistance. Referring to the alarm energizer circuit Iv, a resistor $R_{16}$ is connected between the first input terminal of the NOR circuit $N_3$ and ground, and a resistor $R_{14}$ is connected between the other input terminal and ground. An oscillator circuit $OSC_2$ surrounded by a dotted line is connected to the second input terminal of NOR circuit $N_3$ via a capacitor $C_8$ and is further connected to a connecting point Q between resistor $R_{10}$ and Zener diode ZD.

The oscillator circuit $OSC_2$ consists of a NOR circuit $N_4$, inverters $In_1$ and $In_2$, resistors $R_{11}$ to $R_{13}$ and a capacitor $C_7$. The input terminal of the inverter $In_1$, i.e., the input terminal of this oscillator circuit is connected to connection point Q, and the output terminal of the inverter $In_2$, i.e., the output terminal of this oscillator circuit is connected to the second input terminal of the NOR circuit $N_3$ via the capacitor $C_8$. The resistor $R_{11}$ is connected between the output terminal of the NOR circuit $N_4$ and the input terminal of the inverter $In_1$, resistors $R_{12}$ and $R_{13}$ are connected in series between one input terminal and the output terminal of said NOR circuit, and the capacitor $C_7$ is connected between the output terminal of the inverter $In_2$ and the connection point between the resistors $R_{12}$ and $R_{13}$.

With this oscillator circuit $OSC_2$, when a low level input signal is fed to the inverter $In_1$, its output becomes a high level signal which is fed to the NOR circuit $N_4$ to close it. That is, the NOR circuit $N_4$ always produces a low level output signal, so that the output of the inverter $In_2$ always becomes a high level signal; the oscillator circuit does not oscillate. When the input turns from a low level to a high level, the inverter $In_1$ produces a low level output signal, causing the NOR circuit $N_4$ to open so that the oscillator circuit oscillates; the inverter $In_2$ alternately produces a high level signal and a low level signal.

In the alarm energizer circuit IV, the output terminal of the NOR circuit $N_3$ is connected to one input terminal of the NOR circuit $N_2$, and an inverter $In_3$, a resistor $R_{17}$ and a capacitor $C_9$ are connected in series between this output terminal of NOR circuit $N_2$ and the ground. The connecting point between the resistor $R_{17}$ and the capacitor $C_9$ is connected to one input terminal of NOR circuit $N_1$. The output terminal of oscillator circuit $OSC_1$ of the booster circuit II is connected to the other input terminal of the NOR circuit $N_1$, the output terminal of the NOR circuit $N_1$ is connected to the other input terminal of the NOR circuit $N_2$, and the output terminal of said NOR circuit $N_2$ is connected to the base of a transistor $Tr_2$ for exciting an alarm relay A.

The oscillator circuit $OSC_1$ consists of inverters $In_4$ to $In_6$, resistors $R_{18}$ and $R_{19}$, and a capacitor $C_{15}$, wherein these inverters are connected in series as shown, the inverter $In_5$ having a feedback voltage applied thereto by the resistors $R_{18}$ and $R_{19}$, and the inverters $In_4$ and $In_5$ having a feedback voltage applied thereto by the capacitor $C_{15}$. Consequently, the circuit is always placed in an unstable state, whereby the output terminals of the inverters $In_4$ and $In_6$ produce voltages which alternately change between a high level signal and a low level signal. The voltages are rectified through a voltage multiplying rectifier circuit REC (multiplied four fold in this example) composed of diodes $d_3$ to $d_7$, and capacitors $C_{10}$ to $C_{14}$, whereby a high negative voltage is produced on the output terminal R. These oscillator circuits $OSC_1$ and $OSC_2$ are powered by the power supply E.

The operation of the circuit of FIG. 1 is described below. The oscillating output of the oscillator circuit $OSC_1$ under ordinary conditions is rectified and boosted by the voltage multiplying rectifier circuit REC, and a high negative potential produced on the output terminal R is applied to the inner electrode 1 of the inner ionization chamber IC, whereby the intermediate electrode 2 is maintained at a predetermined potential under the influence of the potential of the conductor $l_1$ applied to the outer electrode 3. In this state, the field effect transistor $F_2$ is turned off, and a low level input signal is fed to one input terminal of the NOR circuit $N_3$ through the resistor $R_{16}$. Referring to the oscillator circuit $OSC_2$, on the other hand, the input level thereof is pulled toward the high negative potential side of the output terminal R by means of the Zener diode ZD and becomes a low level signal. The output of the oscillator circuit $OSC_2$, therefore, is always a high level signal as mentioned earlier. The high level output signal, however, is interrupted by the capacitor $C_8$, whereby a low level input signal is fed to the other input terminal of the NOR circuit $N_3$ through the resistor $R_{14}$. Therefore, the NOR circuit $N_3$ produces a high level output signal which is applied to one input terminal of the NOR circuit $N_2$, causing the NOR circuit $N_2$ to produce a low level output signal and rendering the transistor $Tr_2$ nonconductive. The relay A therefore is not energized, and an alarm is not produced. The high level output signal of the NOR circuit $N_3$ is inverted into a low level signal by the inverter $In_3$, and is fed to one input terminal of the NOR circuit $N_1$ via the resistor $R_{17}$. Alternate low and high signal levels produced by the oscillator circuit $OSC_1$ are fed to the other input terminal of the NOR circuit $N_1$. The NOR circuit $N_1$, accordingly, produces alternate high and low signal levels correspondingly and applies them to the other input terminal of the NOR circuit $N_2$. However, since a high level input signal has been applied to one input of said circuit $N_2$, the outputs of the NOR circuit $N_1$ are all ineffective.

When the smoke is detected, the potential of the intermediate electrode 2 is decreased causing the field effect transistor $F_2$ to be turned on, whereby a high level input signal enters the input terminal of the NOR circuit $N_3$ via the resistor $R_{15}$, and the output of the NOR circuit $N_3$ because a low level. Consequently, the NOR circuit $N_2$ is opened to produce alternate low and high output signal levels responsive to the alternate high and low output signal levels produced by the NOR circuit $N_1$, thereby causing the transistor $Tr_2$ to be turned alternately on and off. As a result, the relay A is intermittently energized. Thereafter, an input which is obtained by inverting the low level output signal of the NOR circuit $N_3$ into a high level signal by the inverter $In_3$ is applied to one input terminal of the NOR circuit $N_1$ and delayed by the resistor $R_{17}$ and the capacitor $C_9$. After a predetermined period of time has passed, the NOR circuit $N_1$ is closed to always produce a low level output signal, and the NOR circuit $N_2$ produces a high level output signal to maintain the transistor $Tr_2$ in a conductive state continuously. The relay A therefore is continuously energized to close the contact a. Thus, the contact a is first intermittently closed and is, thereafter, continuously closed to energize the buzzer B consuming less electric power.

When the capacity of the battery is decreased, the output voltage of the oscillator circuit $OSC_1$ is lowered causing the Zener diode ZD to be turned off. The input fed to the oscillator circuit $OSC_2$ is then switched from a low level to a high level, whereby the oscillator circuit $OSC_2$ starts to oscillate. When the smoke detector is not detecting the smoke, its output remains in the low level as mentioned earlier, and the NOR circuit $N_3$ produces an output which alternates from a low level signal to a high level signal in synchronism with the output of the oscillator circuit $OSC_2$. The NOR circuit $N_2$ receives the outputs of both oscillator circuits $OSC_1$ and $OSC_2$, and produces a high level output when these two outputs are both a low level and produces a low level output when these two outputs are not simultaneously high level signals. As a result, the relay A is intermittently energized causing the buzzer B to be intermittently energized, thereby indicating the depletion of the battery. Although the oscillator circuits $OSC_1$ and $OSC_2$ are not particularly synchronized, if the output frequencies differ slightly, the states in which the two outputs are both in a low level state or not in a low level state are periodically repeated.

According to the circuit of the present invention which performs the oscillation and the voltage multiplying rectification, the smoke detector V can be properly operated using only one or two dry batteries. Further, since the smoke detector which requires the high voltage is the only load for the booster circuit, and the other circuits are directly connected to the dry batteries, it is possible to reduce the electric power required by the booster circuit. In addition, the power loss caused by the booster circuit can be minimized. Furthermore, since the potential at the point Q, which is related to the potential at the point R, or in other words, since the boosted potential of the battery is monitored, it is possible to detect the voltage variation or the reduction of capacity of the battery with a high sensitivity.

The test switch SW is to test whether the ionization-type smoke sensor properly operates or not. If the test switch SW is turned on, the voltage of the power supply E applied to the electrode 3 of the outer ionization chamber OC is reduced, and the potential of the intermediate electrode 2 becomes the same potential as when smoke flows into the outer ionization chamber OC; the buzzer B is energized by the same procedure as when smoke is detected. It is convenient if the test switch SW is so constructed that the testing can be performed simply by pressing it from the exterior of the housing.

Figure 2:
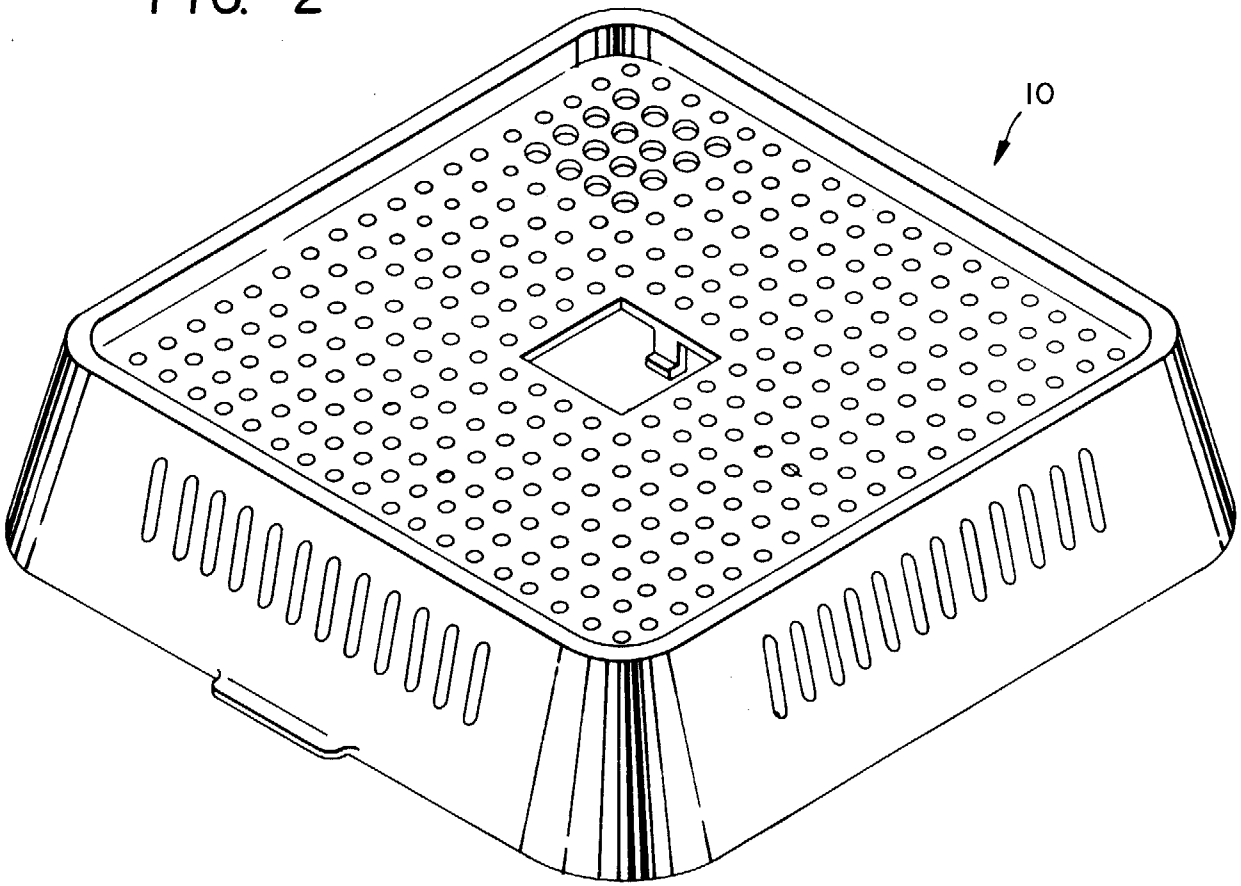
FIG. 2, FIG. 3 and FIG. 4 are perspective views showing in a disassembled manner the ionization-type smoke sensor according to the present invention.
Figure 3:
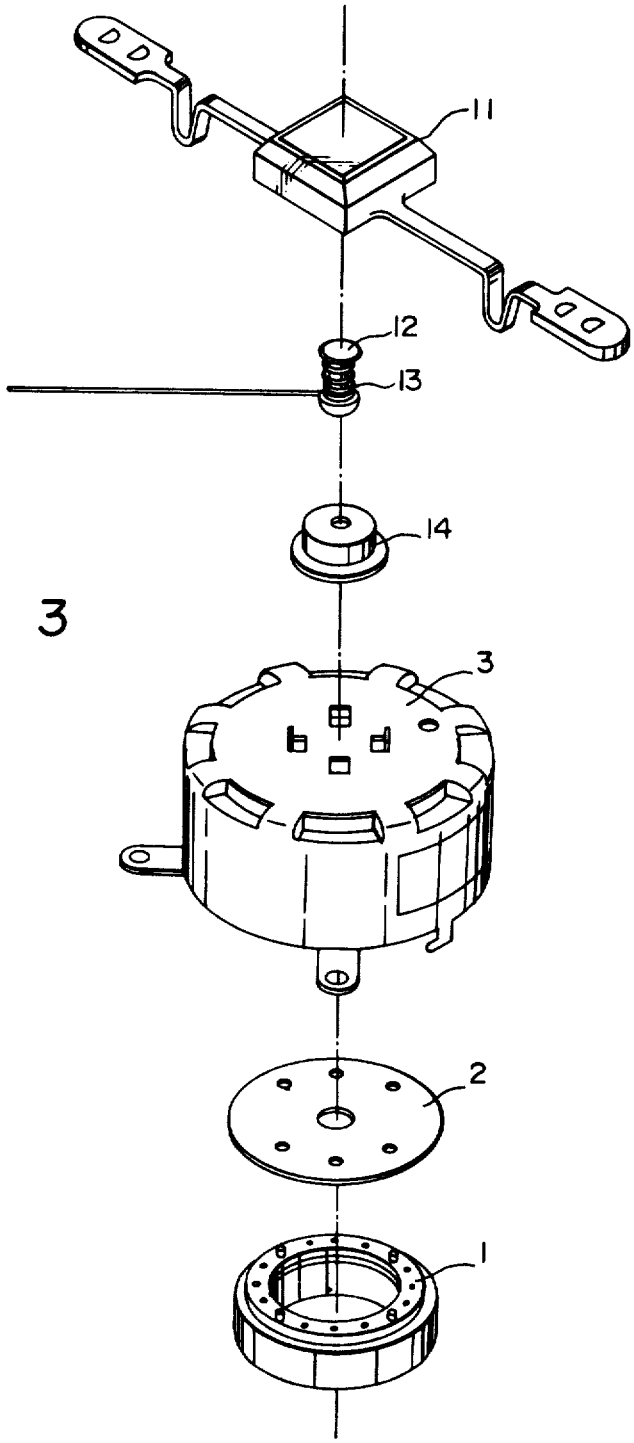
Figure 4:
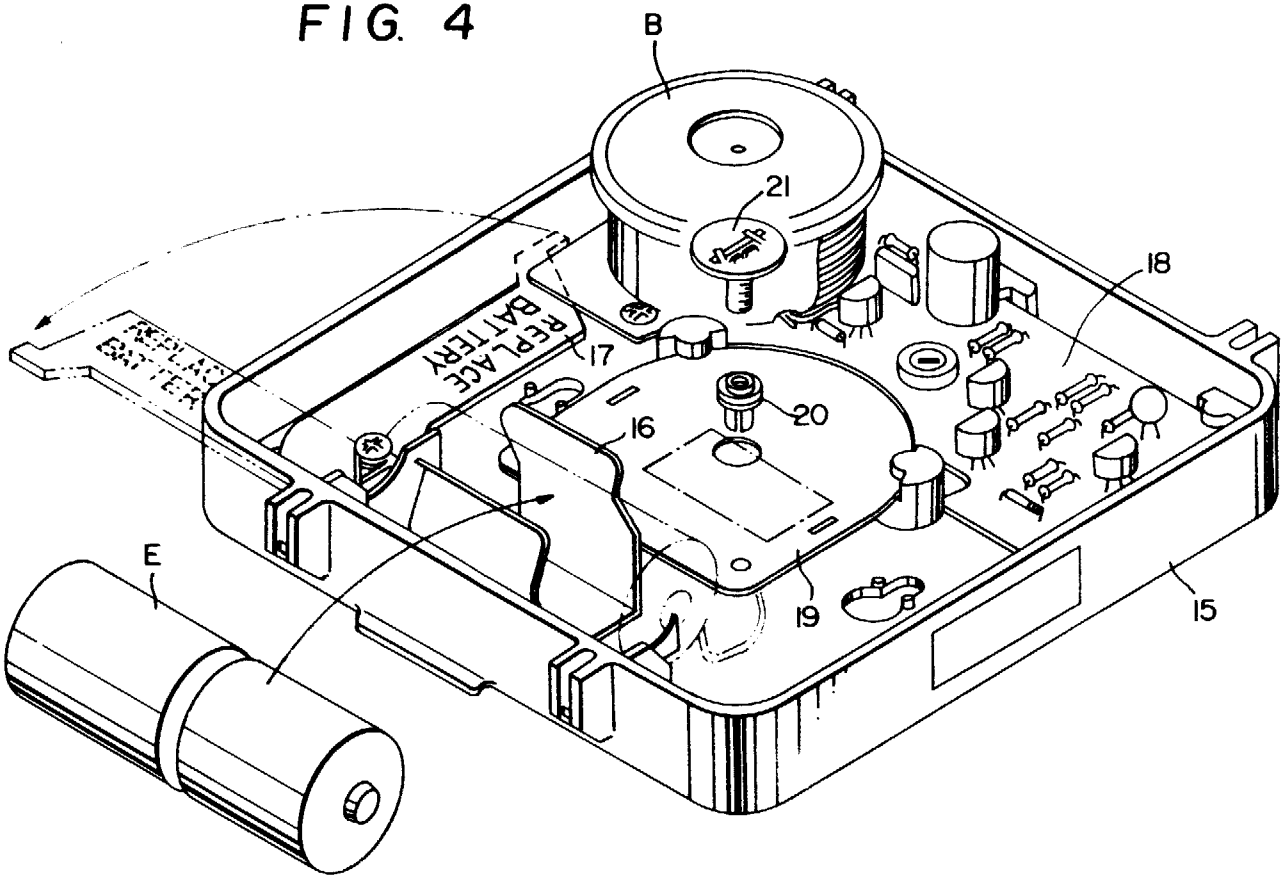

FIG. 2, FIG. 3 and FIG. 4 are perspective views showing in a disassembled manner the ionization-type smoke sensor to which the present invention is applied. FIG. 2 shows a cover 10 of the smoke sensor. FIG. 3 shows a depression portion 11 of the test switch SW, a contact 12, a spring 13, a switch holder 14, the outer electrode 3 of the outer ionization chamber of the smoke detector, the intermediate electrode 2 and the inner ionization chamber 1. FIG. 4 shows a substrate 15, the buzzer B, dry battery E, a holder 16 for holding the dry battery, a flag 17 for indicating that the battery is depleted, a circuit 18, a support plate 19 for supporting the smoke detector, a screw 20, a source of radiation, and the inner electrode 21.

According to the present invention as illustrated in detail in the foregoing, the ionization-type smoke sensor can be operated with the low voltage produced by one or two ordinarily used dry batteries, making it possible to produce a fire sensor for household use in a small size accommodating all necessary parts in a housing. In addition, the reduced capacity of the battery is indicated utilizing the alarming bell, enabling the sensor itself to be reliably used.

What is claimed is:

1. A single station type ionization smoke sensor comprising:

a battery having a first terminal connected to ground and a second terminal;

an ionization-type smoke detector means having first and second opposed electrodes and an output electrode for detecting combustion products and generating an output signal on said output electrode;

a primary power feed conductor connected between said second terminal of said battery and said first opposed electrode;

a voltage booster means connected to said battery and having a booster terminal for generating a boosted voltage signal on said booster terminal having a voltage higher than the voltage of said battery and opposite in polarity to the voltage on said second terminal of said battery;

a secondary power feed conductor connected between said booster terminal and said second opposed electrode;

a series connection of a resistor element and a zener diode connected between said primary and secondary power feed conductors;

a voltage detector means having an input terminal connected to the junction between said resistor element and said zener diode and an output terminal, for generating an output signal on said output terminal if the voltage on said input terminal falls below a predetermined value; and an alarm energizer circuit having a first input terminal connected to said output terminal of said ionization-type smoke detector means and a second input terminal connected to said output terminal of said voltage detector means for generating an alarm when said ionization-type smoke detector means generates said output signal and for generating an alarm when said voltage detector means generates said output signal.

2. A single station type ionization smoke sensor as claimed in claim 1, wherein:

said voltage detector means comprises a first oscillator circuit for generating a first oscillation signal having substantially the equivalent voltage as said output signal of said ionization-type smoke detector means when the voltage on said voltage detector means input terminal falls below said predetermined value; and said alarm energizer circuit comprises a first NOR circuit having a first NOR input terminal connected to said voltage detector means output terminal, a second NOR input terminal connected to said ionization-type smoke detector means output terminal and a first NOR output terminal for generating a first continuous alarm signal on said first NOR output terminal when said ionization-type smoke detector means generates said output signal and for generating a second intermittent alarm signal on said first NOR output terminal when said first oscillation circuit generates said first oscillation signal.

3. A single station type ionization smoke sensor as claimed in claim 2, wherein:

said voltage booster means comprises a second oscillator circuit for generating a second oscillation signal, and a voltage multiplying rectifier circuit having said second oscillation signal applied thereto for rectifying said second oscillation signal, for multiplying the voltage of said second oscillation signal into said boosted voltage signal and for applying said boosted voltage signal to said booster terminal; and said alarm energizer circuit further comprises a second NOR circuit having a third NOR input terminal having said second oscillation signal applied thereto, a fourth NOR input terminal connected to said first NOR output terminal and a second NOR output terminal for generating a third intermittent alarm signal having the frequency of said second oscillation signal on said second NOR output terminal upon generation of said first continuous alarm signal and for generating a fourth intermittent alarm signal having a compound frequency related to the frequencies of said first and second oscillation signals on said second NOR output upon generation of said second intermittent alarm signal.

* * * * *